United States Patent [19]

Hanagata et al.

[11] 4,030,588

[45] June 21, 1977

[54] PRINTER

[75] Inventors: Takayoshi Hanagata, Yokohama; Hideki Gushima, Kodaira; Mitsuaki Seki, Tokyo, all of Japan

[73] Assignee: Canon Kabushiki Kaisha, Tokyo, Japan

[22] Filed: Apr. 8, 1975

[21] Appl. No.: 566,075

Related U.S. Application Data

[63] Continuation of Ser. No. 368,534, June 11, 1973, abandoned.

[30] Foreign Application Priority Data

June 19, 1972 Japan ..... 47-61166

[52] U.S. Cl. ..... 197/1 R; 197/82; 197/127 R; 346/76 R

[51] Int. Cl.[2] ..... B41J 3/04

[58] Field of Search ..... 197/1 R, 16, 18, 50, 197/65, 66, 67, 82, 114, 120, 127; 346/76 R, 138, 139; 219/216

[56] References Cited

UNITED STATES PATENTS

| | | | |
|---|---|---|---|
| 2,741,530 | 4/1956 | Hill | 346/138 |
| 2,743,989 | 5/1956 | Clurman et al. | 346/139 A X |
| 2,850,350 | 9/1958 | Wise et al. | 346/139 A X |
| 3,554,347 | 1/1971 | Perkins | 197/65 X |
| 3,578,129 | 5/1971 | Kato et al. | 197/65 X |
| 3,596,055 | 7/1971 | Elston | 197/1 UX |
| 3,643,775 | 2/1972 | Kittel et al. | 197/120 X |
| 3,710,913 | 1/1973 | Brennan et al. | 197/1 R |
| 3,759,361 | 9/1973 | Link | 197/65 |
| 3,779,359 | 12/1973 | Morrison et al. | 197/66 |
| 3,789,971 | 2/1974 | Deyesso et al. | 197/18 |

*Primary Examiner*—Ralph T. Rader
*Attorney, Agent, or Firm*—Fitzpatrick, Cella, Harper & Scinto

[57] ABSTRACT

High speed printing apparatus used as output units of computers or the like is disclosed. The apparatus includes a print head, a driving means for moving the head and feeding a record medium and means for applying a driving control signal to the driving means. Only one driving means is advantageously available for accomplishing all operations of the apparatus so that simple construction thereof may be obtained.

12 Claims, 16 Drawing Figures

| FIG. 14A | FIG. 14B |
|---|---|

PRINTER

This is a continuation, of application Ser. No. 368,534, filed June 11, 1973, now abandoned.

BACKGROUND OF THE INVENTION

1. Field of the Invention

The present invention relates generally to a printer for use with a computer, typewriter or the like, and more particularly to a simple construction of a printer of the type in which a print head is moved at a high speed for printing.

2. Description of the Prior Art

The conventional printers of the type in which a print head is moved over a printing surface have been used as output units of computers and typewriters, and various improvements have been made in order to attain high speed printing and to make their construction simple. However there still remain many problems and defects which have not been successfully solved. For example in order to advance a paper after one line has been printed, to return a carriage to its initial position and to change the print position of a print head, there have been used various driving means such as plungers, motors, return springs and so on. As a result the conventional printers are large in size. Furthermore many indeterminate factors are involved so that the precise operation of the printer is not expected. It is therefore unavoidable that the drive control circuit for the driving means is very complex and the power consumption is increased.

There has been a strong demand for portable equipment such as desktop computers so that a printer incorporated therein must be compact in size, light in weight and lower in power consumption.

SUMMARY OF THE INVENTION

One of the objects of the present invention is therefore to provide a high speed printer compact in size and light in weight.

Another object of the present invention is to provide a high speed printer in which all the operations required for printing may be accomplished by a single driving means which in turn is controlled in response to the driving signals for a control unit.

Another object of the present invention is to provide a high speed printer in which a print head may be located at a print start position with a higher degree of accuracy. In the conventional printers of the type described above, it has been difficult to locate a print head correctly at a print start position because of the inertia of the print head and the complex driving means used.

Another object of the present invention is to provide a high speed printer in which a drive control circuit is very simple in construction because the printing mechanism is simplified.

Another object of the present invention is to provide a high speed printer which is very effective for cleaning a print head.

Another object of the present invention is to provide a thermal print head which is so constructed as to improve the heat dissipation.

The above and other objects of the present invention will become more apparent from the following description of one preferred embodiment thereof taken in conjunction with the accompanying drawing in which:-

BRIEF DESCRIPTION OF THE DRAWINGS

FIG. 14 is a combination of FIGS. A and B.

DESCRIPTION OF THE PREFERRED EMBODIMENTS'

Figure 1:
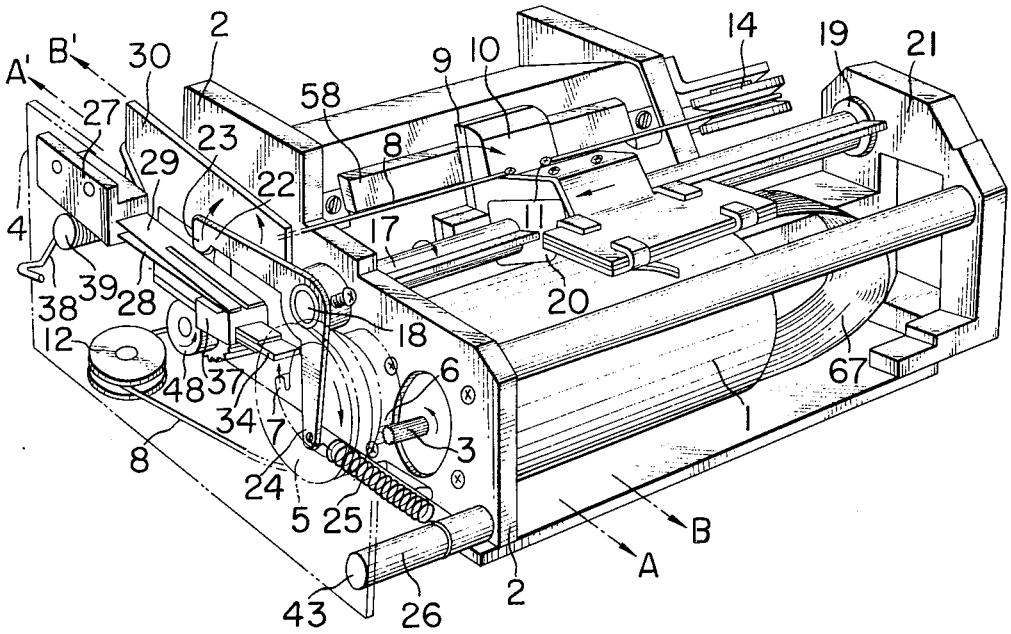
FIG. 1 is a perspective view of a printer in accordance with the present invention.

Referring to FIGS. 1 through 5, a driving mechanism in a preferred embodiment of the invention may be explained hereinafter.

Driving means 1 is adapted to accomplish various functions such as advancing and returning a print head 9, changing its print position, and advancing line by line a sheet of paper as a recording medium. In the instant embodiment, driving means comprises a reversible step motor or pulse motor whose stator is securely fixed to an intermediate side plate 2 and whose rotary shaft 3 is in mesh with a gear 6 of a pulley 5. The pulley 5 is rotatably carried by a shaft 42 which in turn is supported by a left side plate 4, and is intermittently driven by the step or pulse motor 1 through the rotary shaft 3. A wire 8 whose both ends are fixed is wrapped around the pulley 5 in such a manner that when the wire is wound or unwound by the pulley 5 the intermittent rotation of the step motor 1 may be translated into intermittent rectilinear motion. The wire 8 is fixed to a head holder or carriage 10 carrying the print head 9 with suitable fastening means 11 such as screws, curved projections eyelets or the like. Therefore the carriage or print head holder 10 is intermittently advanced to print the characters upon the paper by the endless wire 8 which is also wrapped around rollers 12, 13, 14 and 15 disposed around the main body of the printer so that the latter may become simple in construction and compact in size.

The carriage 10 is slidably carried by a shaft 17 so as to maintain a desired angular position of the print head 9 relative to the paper 16. In the instant embodiment, a slider member 20 made of plastic is attached to the back of the carriage 10 in order to improve the smooth sliding motion of the carriage 10 along the shaft 17. The shaft 17 is rotatably supported by bearings 18 and 19 which in turn are fixed to a right side plate 21 and the intermediate side plate 2, respectively, and a rocker 22 is fixed to one end of the shaft 17 on the side of the bearing 18. A spring 25 is loaded between a pin 26 extending from the intermediate side plate 2 and one end 24 of the rocker 22 so that the shaft 17 is so biased as to cause the carriage 10 and hence the print head 9 to be pressed against the paper 16 and a pad 58. Upon the left side plate 4 are rotatably disposed the shaft 42 of the pulley 5, and the rollers 12 and 13. A switch 27 for detecting the end of the return stroke of the print head 9, a pivot pin 39 of a paper feed lever 30, and stopper pins 40 and 41 for the lever 30 are also disposed on the left side plate 4. One end 33 of the paper feed lever 30 is pivoted with the pin 39 to the left side plate 4, and is loaded with a spring 38 so as to be normally downwardly biased and arrested by the stopper pin 40. A paper feed pawl 46 is pivoted with a pin 31 to the other end 32 of the lever 30 which is in coplanar relation with the one end 33. A detecting member 34 for detecting the position of a projection 7 of the pulley 5 is formed integral with the paper feed lever 30 and bent at a right angle relative to the flat surface of the lever 30 is moved upwardly by the projection 7 so as to cause contacts 28 and 29 of the switch 27 to close immediately before the detecting member 36 is arrested by the upper stopper pin 41. When the switch 27 is closed, it gives the signal representing that the print head 9 has reached the end of its return stroke to a control unit 70 to be described in detail hereinafter with reference to FIG. 10. The projection detecting member 34 is provided with shock absorbers 35 and 36 in order to attenuate the noise caused when the member 34 strikes the stopper pins 40 and 41 and with an actuating member 37 made of an insulating material for making the contacts 28 and 29 to contact with each other. The pawl 46 pivoted to the lever 30 is so biased by a spring 45 as to engage with teeth 49 and 50 of a ratchet wheel 48 carried by a rotary shaft 51 of a paper feed roller 53. When the ratchet wheel 48 is rotated by one tooth, the paper 16 is moved by one line. The paper 16 is pressed against the paper feed roller 53 by pressure rollers 54 which are supported by a part 62 of a guide 60 for the paper 16. The part or member 62 is formed by partially longitudinally cutting the guide 60 from the portion 61. The pressure rollers 53 may be urged with the uniform pressures due to the elasticity of the member 60. The platen or pad 58 is made of an elastic material such as rubber and supported by a supporting plate 55. A thin intermediate member 59 is made of a material having the resistance to heat and a small coefficient of friction. In the instant embodiment the member 59 is made of polyfluoroethylene fiber sold under the trademark of "Teflon" from E.I. DuPont de Nemours and Co., Inc., U.S.A. One end of the member 59 is fixed to one end 57 of the supporting plate 55 whereas the other end 56 is fixed with an adhesive tape or the like in such a manner that the member 59 may be extended under suitable tension without bonding with, but contact with the pad 58. In the conventional printer, the thin membrane 59 is directly applied over the pad 58 so that the deformation such as creases of the surface of the thin membrane 59 occurs due to the expansion and contraction caused by the temperature and humidity variations, the heat generated by the friction of the print head and its mechanical displacement. As a result it was impossible to maintain the uniform contact between the print head and the paper. Furthermore the correct insertion of the paper is difficult because the edge of the paper makes contact with the pad. However according to the present invention the thin membrane 59 is not bonded to the pad 58 but is in light contact therewith, and the paper is guided by the supporting plate 55 so that the above problems are completely eliminated.

For the pad with the above construction is adapted a thermal head in which dot and segment elements are selectively energized and heated to cause the chemical reaction of a heat-sensitive paper. In the instant embodiment a thermal head is used, but it will be understood that the present invention is not limited to the use of a thermal head.

Figure 6:
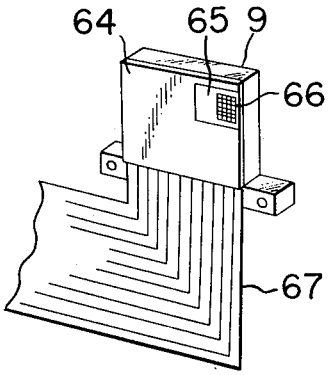
FIG. 6 is a perspective view illustrating a thermal print head used in the present invention.
Figure 10:
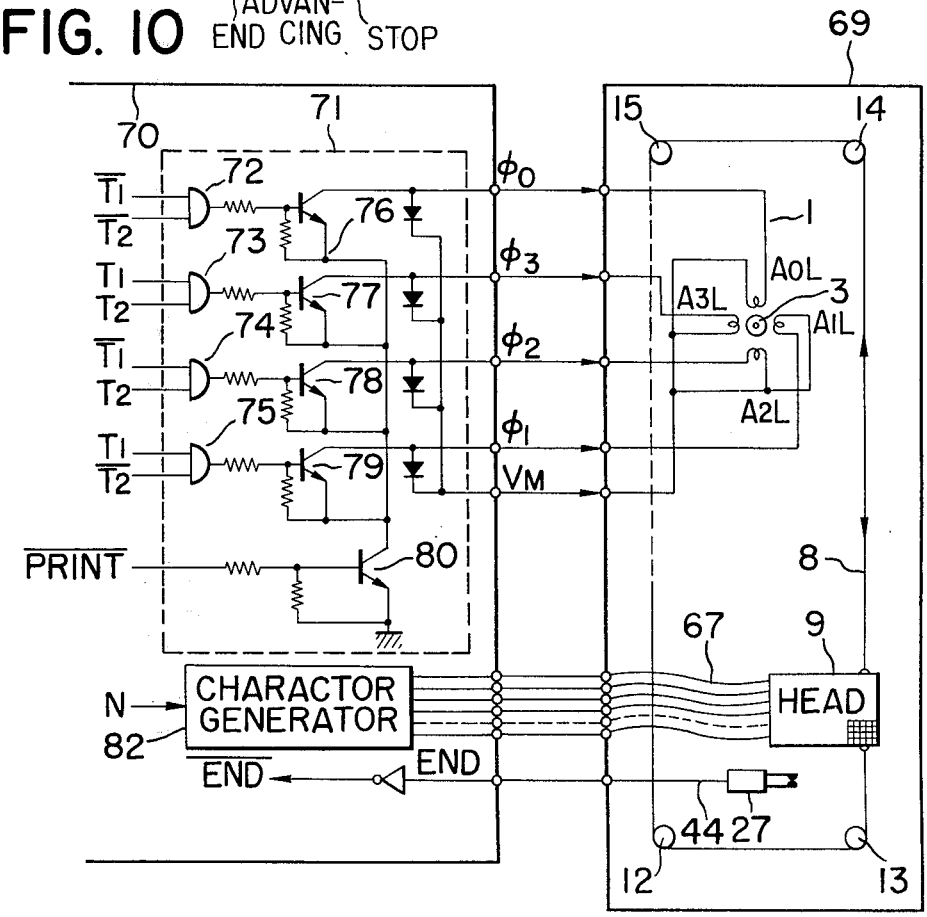
FIG. 10 is a diagram of an interconnection between a printing section and a control section of the printer of the present invention.

A thermal head used in the instant embodiment is shown in FIG. 6. a plurality of heat generating elements 66 each incorporating therein a resistor are arrayed on a semiconductor substrate such as silicon, and the elements 66 are selectively energized by a current flow thereby to print characters and numerals on a heat-sensitive paper. A ceramic member 64 supports the silicon substrate 65 to dissipate the heat generated by the elements 66 into the heat sink 9 made of aluminum. A flexible cable 67 is provided in order to selectively energize the heat-generating elements 66. The flexible cable 67 is connected to a character generator 82 in the control unit 70 as shown in FIG. 10.

The step motor 1 is of the four-phase type, and makes one rotation in response to four pulses. When the pulses $\phi_0$, $\phi_1$, $\phi_2$ and $\phi_3$ are generated by a pulse generator 71, the rotor of the step motor 1 is rotated stepwise by 90° in accordance with the order of the coil positions from $A_3L$ to $A_0L$, from $A_0L$, from $A_1L$ to $A_2L$ and from $A_2L$ to $A_3L$. When the step motor 1 rotates through 90°, the wire 8 is wound around the pulley 5 by a length corresponding to one character space so that the carriage 10 is moved a distance equal to one character space. On the other hand when the pulses are generated in the order of $\phi_3$,$\phi_2$,$\phi_1$, and $\phi_0$, the rotation of the step motor 1 is reversed in accordance with the order of the coil positions, from $A_0L$ to $A_3L$, from $A_3L$ to $A_2L$, from $A_2L$ to $A_1L$ and from $A_1L$ to $A_0L$, so that the carriage 10 is returned to its initial position. The step motor 1 is so designed that it stops at the coil position $A_0L$ when the carriage is in its initial position.

Figure 11:
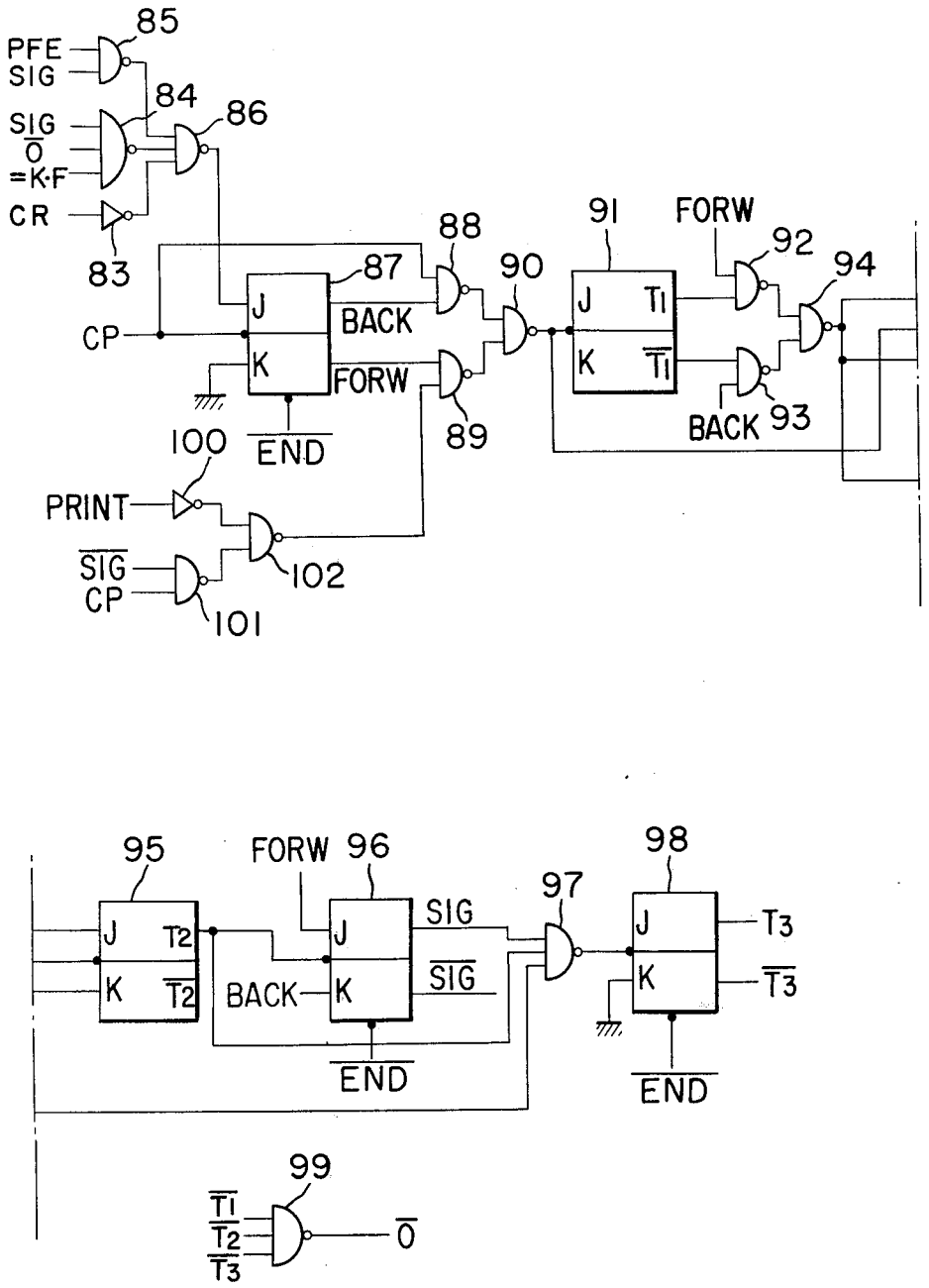
FIG. 11 is a block diagram of a counter which is a part of a motor driving means in the control section shown in FIG. 10.
Figure 12:
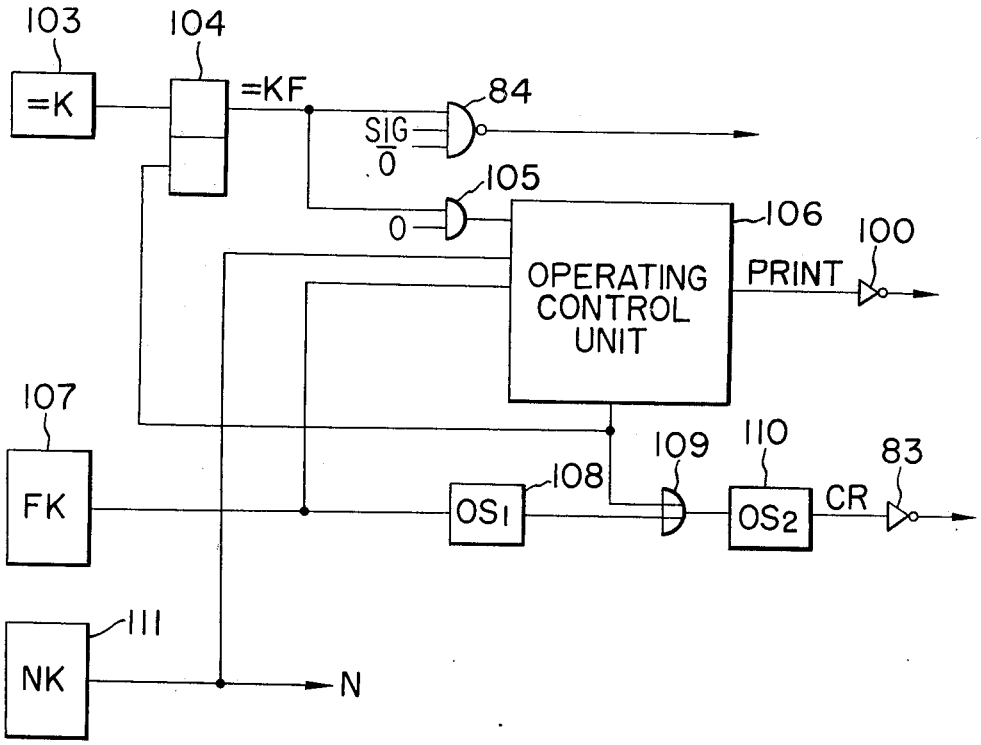
FIG. 12 is a block diagram of the remaining portion of the control section shown in FIG. 10.

A control unit for controlling the drive of the step motor 1 is shown in FIGS. 11 and 12. Reference numeral 83 denotes an inverter for inverting the print head return instruction or carriage return signal CR from an arithmetic or control unit of a computer. 84 denotes a NAND gate to which are applied the command signal, =KF for the result of the arithmetic operation from an external control unit such as a keyboard of a computer, the output signal $\overline{0}$ of a NAND gate 199 to be described hereinafter and the set output signal SIG of a flip-flop 96 to be described hereinafter. 85 denotes a NAND gate to which are applied the paper feed instruction PFE from the keyboard and the set output signal SIG of the flip-flop 96. 86 denotes a NAND gate to which are applied the output signals of the NAND gates 83, 84 and 85. It is to be noted that in the positive logic the NAND gate gives a high-level output signal when at least one input signal is at low level, and in the instant the positive logic circuits are employed. 87 denotes a flip-flop to which is applied the output signal of the NAND gate 86 and which is set in response to the fall of the clock pulse, thereby giving the BACK signal for reversing the step motor 1 so as to return the carriage 10. The flip-flop 87 is also normally reset state giving the FORWARD signal for driving the step motor 1 in the normal direction so as to step the carriage 10. 88 denotes a NAND gate for synchronizing the BACK signal with the next clock pulse. 89 denotes a gate for transferring the FORWARD signal to the next stage in response to the PRINT signal. 90 denotes a NAND gate to which are applied the output signals of the NAND gates 88 and 89. And 91 denotes a flip-flop of the first stage of a quaternary counter. The flip-flop 91 is normally reset but set in response to the fall of the output signal of the NAND gate 90. Reference numerals 92 and 93 denote NAND gates to which are applied the FORWARD signal and the set signal $T_1$ and the BACKWARD signal and the reset signal $\overline{T}_1$, respectively. 94 denotes a NAND gate to which are applied the output signals of the NAND gates 92 and 93. 95 denotes a flip-flop in the second stage of the quaternary counter to which is applied the output signal of the NAND gate 94 and which reverse its state in response to the fall of the output signal of the NAND gate 90 nd to the fall of the output signal of the NAND gate 94, the flip-flop 95 being normally reset. 96 denotes a flip-flop to the set and reset input terminals of which are applied the FORWARD and BACK signals, respectively, and which is normally reset, but is set in response to the fall of the output signal $T_2$ of the flip-flop 95. When the flip-flop 96 gives the set output signal SIG, the print head is in print position and the information from the character generator 82 is applied through the lead wires 67 to the print head 9 so that the latter is printing a character. When it gives the reset signal $\overline{SIG}$, the print head 9 is returned in response to the clock pulses CP and then advanced to the print-start position from the initial position of the print head so that no printing is made. A NAND gate 97 receives $\overline{SIG}$ signal, $T_2$ signal and the output signal of the NAND gate 94 and gives the output signal to the input terminal of a flip-flop 98. The reset output $\overline{T}_3$ of the flip-flop 98 is normally at high level as same as flip-flop 87. Reference numeral 99 shows a NAND gate which receive the reset outputs $\overline{T}_1$, $\overline{T}_2$ and $T_3$ of the flip-flops 91, 95 and 98, respectively and gives the output signal $\overline{0}$. Reference numeral 100 denotes an inverter for inverting the PRINT signal. 101 denotes a NAND gate to which are applied the $\overline{SIG}$ signal and CP signal. 102 denotes a NAND gate to which are applied the output signals of the inverter 100 and NAND gate 101. 103 denotes a key for generating the command signal for printing the result of the arithmetic operation. 104 denotes a flip-flop which is set in response to the signal from the key 103 and reset in response to the signal from an arithmetic operation control unit 106 to be described hereinafter. Reference numeral 105 denotes an AND gate to which are applied the set output signal =KF from the flip-flop 104 and the output signal $\overline{O}$ of the NAND gate 99. An AND gate gives a high-level output signal when all of the input signals are at high level. Reference numeral 106 denotes the arithmetic operation control unit. 107 and 108 denote function key and a one-shot multivibrator, respectively. 109 denotes OR gate whose output becomes high level when at least one input is at high level. Reference numerals 110 and 111 denote a one-shot multivibrator and a number or digit key for generating the number or digit signal N, respectively.

Figure 13:
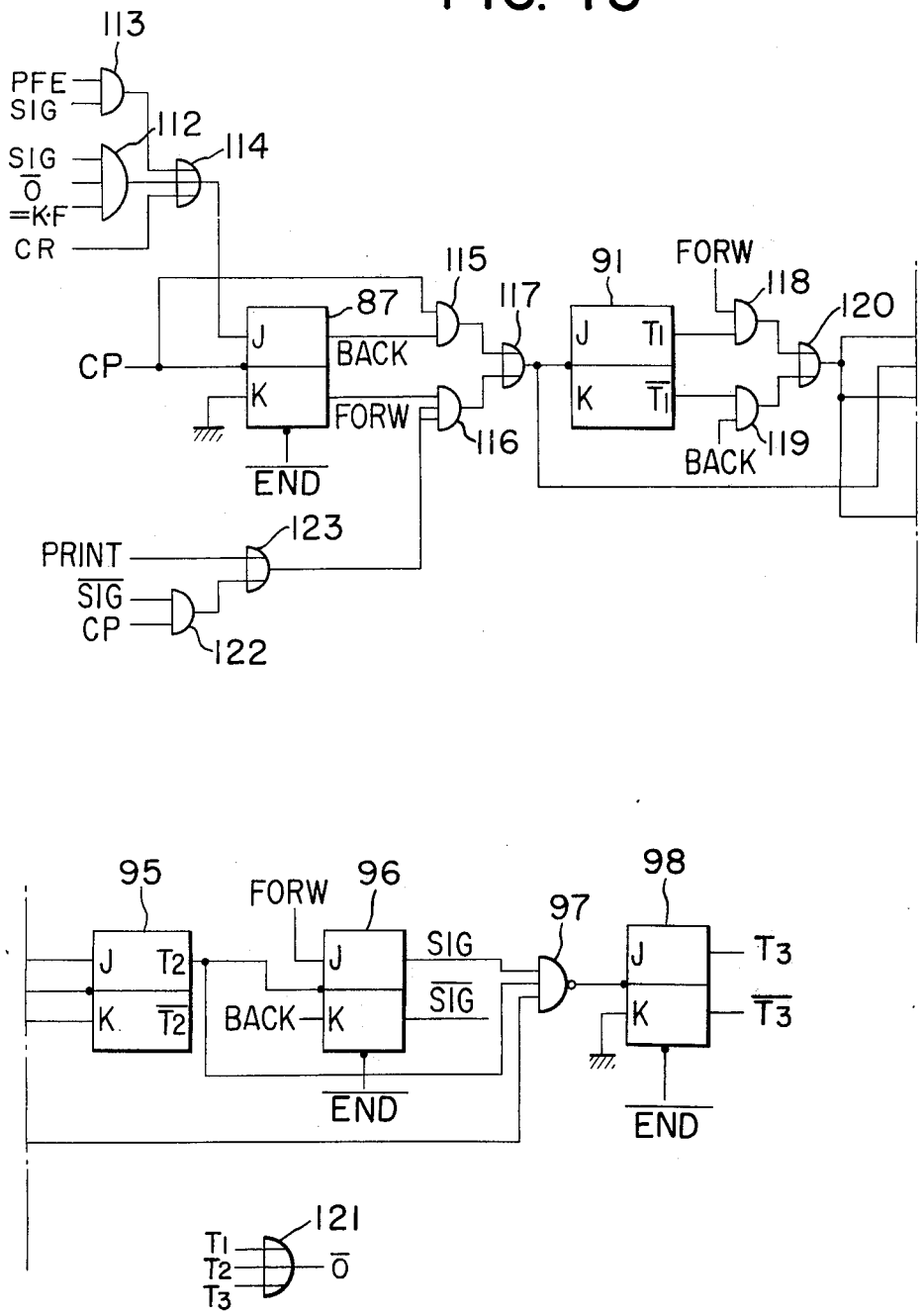
FIG. 13 is an equivalent block diagram of the block diagram shown in FIG. 11 which is used for the explanation of the mode of operation of the counter.
Figures 14, 14A:
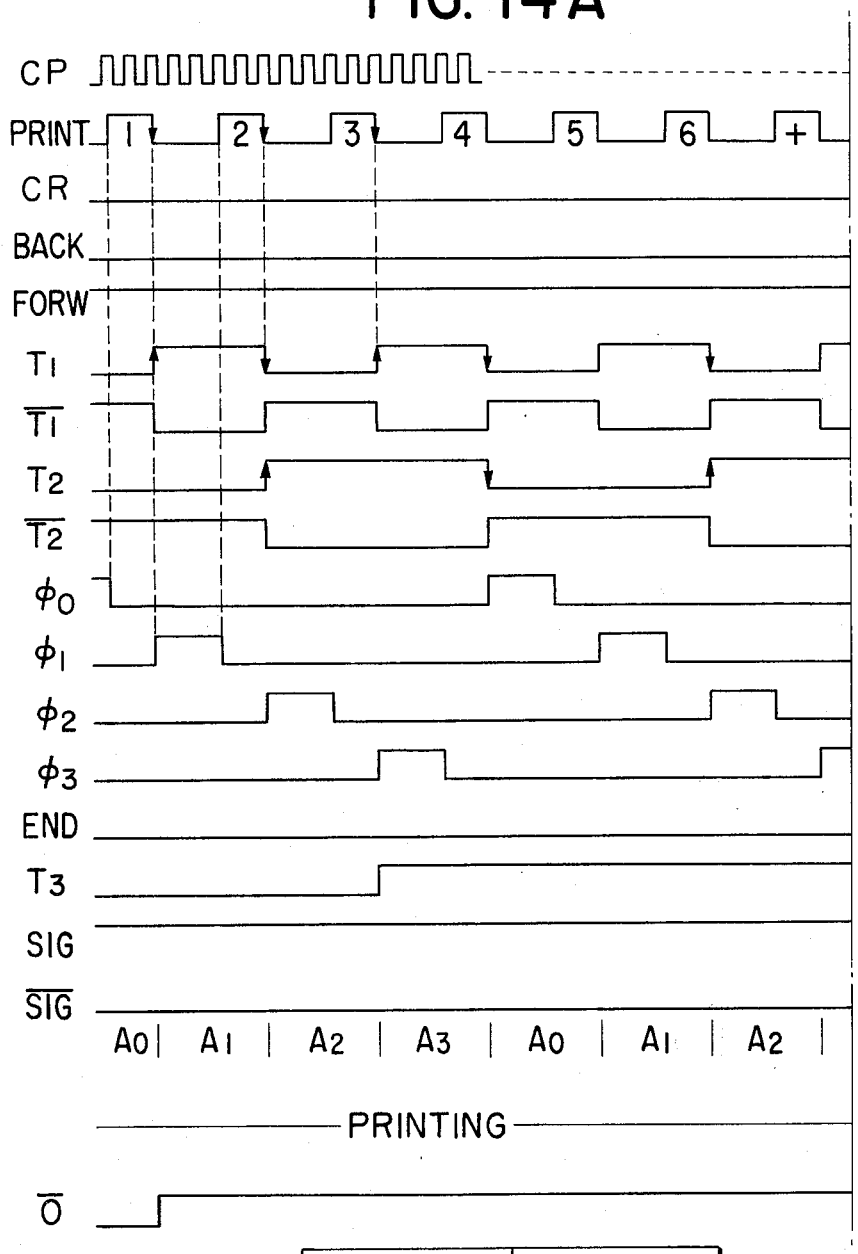
FIGS. 14 A and B illustrate the waveforms used for the explanation of the mode of operation of the control circuit shown in FIGS. 11 (13) and 12.
Figure 14B:
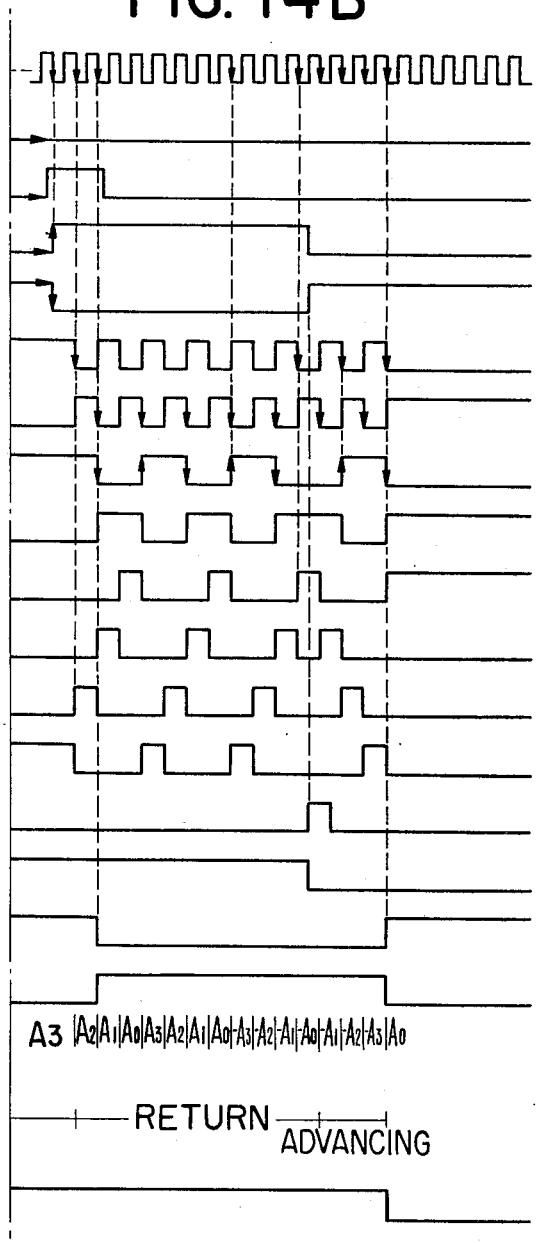

The drive control unit described above is especially adapted to be fabricated as an IC or LSI in practice, but its circuit diagram shown in FIGS. 11 and 12 is too complex to be used in conjunction with the description of the mode of operation thereof so that a circuit diagram shown in FIG. 13 which is a simplified version of the circuit diagram shown in FIGS. 11 and 12 will be used in the following description. The circuit shown in FIG. 13 is an equivalent circuit of the circuit shown in FIG. 11. In other words, the circuit shown in FIG. 11 is converted into the circuit shown in FIG. 13 based upon De Morgan's law, $\overline{\overline{a} \times \overline{b}} = a + b$. In this respect, it is apparent that the circuit shown in FIG. 12 is also modified so that the inverters 83 and 100 may be eliminated. In FIG. 13 the same reference numerals are used to designate the same parts with those shown in FIG. 11. In FIG. 13, reference numerals 112, 113, 115, 116, 118, 119 and 112 denote AND gates, and 114, 117, 120, 121 and 123 denote OR gates. FIGS. 14 A and B illustrate the waveforms of the input and output signals of the component parts shown in FIGS. 13 (11) and 12.

Figure 9:
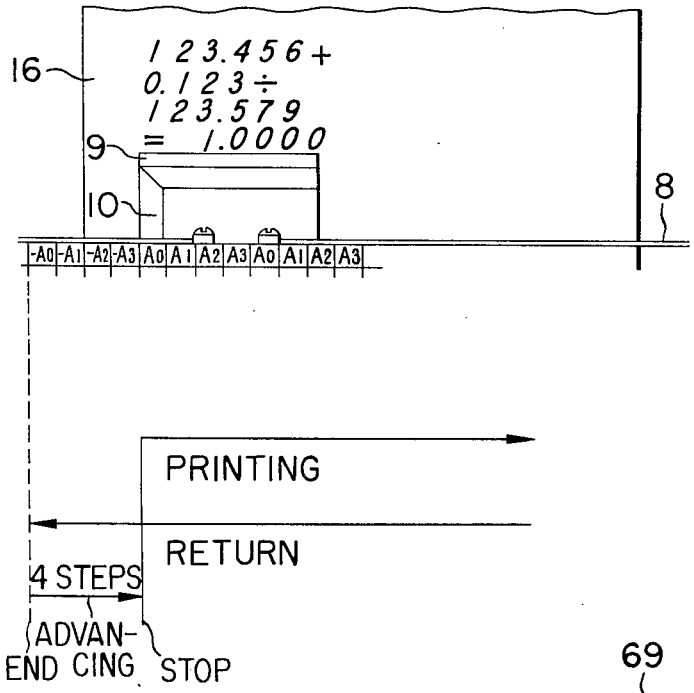
FIG. 9 is a view used for the explanation of the principle of the present invention for moving the print head.

The mode of operation of the printer of the present invention will be described hereinafter when a numeral 123. 456+ is printed. It is assumed that the print head 9 is in print-start position $A_0$ on the paper 16 as shown in FIG. 9. When the digit 1 is entered by the number key(NK) 111 on the keyboard, the signal is stored in the memory such as a register in the character generator 82 shown in FIG. 10 and is also transferred through the lead 67 to the print head 9. As shown in FIG. 12 the key signal is converted into the PRINT signal in the arithmetic control unit 106, and the print head 9 prints "1" at the print-start position $A_0$. The PRINT signal is applied to the AND gate 116 through the OR gate 123, and the flip-flop 87 is reset because the END signal from the switch 27 is applied to the clear input terminal, and the high-level FORWARD signal is applied to the AND gate 116. As a result the AND gate 116 is opened and then the OR gate 117 is opened so that the high-level signal is applied to the flip-flops 91 and 95. Since the flip-flops 91 and 95 are reversed in response to the fall of the signal, they remain in the reset state. When the PRINT signal falls to a low level, the OR gate 123 is closed so that the AND gate 116 is also closed, but the AND gate 115 is not opened. Therefore the OR gate 117 is also closed so that the low-level signal is applied to the flip-flops 91 and 95. The flip-flop 91 is reversed and the set signal $T_1$ is generated. Then the AND gate 118 and the OR gate 120 are opened so that the high level signal is applied to another input terminal of the flip-flop 95. Since the input signals applied to the flip-flop 95 are not in synchronism with each other, the flip-flop 95 will not be reversed. Therefore the content of the counter is 1 when the PRINT signal falls as the signals $T_1$ and $\overline{T}_2$ are at high level, and the output of the counter is applied to the sequential pulse generator 71 shown in FIG. 10 so that the AND gate 75 is opened. As a result the pulse $f_1$ is applied to the coil $A_1L$ of the step motor 1 so that the rotor (not shown) rotates through 90° and stops at the coil position $A_1L$. When the rotary shaft 3 of the step motor 1 rotates through 90°, the pulley 5 shown in FIG. 1 rotates through an angle so that the wire 8 is wound therearound by a length corresponding to one character space. Therefore the print head 9 on the carriage 10 to which is fixed the wire 8 is advanced to the next print position $A_1$ from the print start position $A_0$. Next the numeral key 111 is depressed to enter "2" so that "2" is printed and the OR gate 123 is opened. As a result the AND gate 116 is opened so that the OR gate 117 is opened. As a result the high level signal is applied to the flip-flops 91 and 95, but they are not reversed. That is, the signals $T_1$ and $\overline{T}_2$ remain at high level. When the PRINT signal falls to a low level, the OR gate 123 and the AND gate 116 are closed so that the OR gate 117 is opened. The low-level signal is applied to the flip-flops 91 and 92 so that the flip-flop 91 is reversed and the reset output signal $\overline{T}_1$ is generated. Since the BACK signal is not applied, the AND gate 119 is not opened. Also the AND gate 118 is not opened so that the OR gate 120 is not opened. As a result the low-level signals are applied to the flip-flop 95. That is, the input signals fall at the same time so that the flip-flop 95 is reversed and the set output $T_2$ is generated. Therefore the output signals $\overline{T}_1$ and $T_2$ are both at high level so that the content of the counter is 2. From the AND gate 74 is derived the pulse $\phi_2$ in response to which the step motor 1 is rotated further through 90° so that the print head 9 is advanced to the third print position $A_2$. In like manner when the digit "3" is entered the printing is made in response to the high level PRINT signal, and the pulse $\phi_3$ is generated when the PRINT signal falls to a low level. The carriage 10 is advanced by the intermittent rotation of the step motor 1.

In like manner the printing and the advancement of the carriage, that is the print head are accomplished unitl the digit "6" is printed. Next the + function key (FK) 107 is depressed so that the signal representing the symbol + is applied to the control unit 106 and the symbol + is printed. The signal is delayed by a predetermined time by the oneshot multivibrator $OS_1$, and actuates the oneshot multivibrator $OS_2$. The output signal of the monostable multivibrator $OS_2$ is the carriage return signal CR shown in FIGS. 14 A and B and the set input terminal of the flip-flop 87 becomes high level. Then the flip-flop 87 is set in response to the fall of the clock pulse CP applied to the sync input terminal so that the BACK signal is applied to the AND gate 115. Simultaneously, the reset output signal, that is FORWARD signal falls to a low level and the AND gate 116 is closed. The AND gate 115 applies the clock pulse CP to the flip-flop 91 through the OR gate 117. The AND gate 118 is closed but the AND gate 119 is opened. As a result the counter counts in a subtraction manner the fall of the clock pulses when the print head is returned. The content of the counter is decoded to generate the pulse train $\phi_3$, $\phi_2$, $\phi_1$ and $\phi_0$ from the pulse generator 71. As a result the step motor 1 is intermittently rotated in the reverse direction. Since the frequency of the clock pulses CP is considerably higher than that of the PRINT signal, the wire 8 is almost continuously wound around the pulley at a high speed so that the carriage 10 is immediately returned. The carriage 10 passes beyond the print-start position $A_0$ to the end of the return stroke at which the switch 27 is closed. When the carriage 10 is stationary at the print-start position, the projection 7 of the pulley 5 and the projection detecting member 34 are located at the positions indicated by the solid lines in FIG. 2. That is, the projection 7 of the pulley 5 is located on the boundary line between the ranges A and B. One end 23 of the lever 22 for changing the print position of the print head is released whereas the other end 24 is exerted with the tension by the spring 25 so that the print head 9 on the carriage 10 is pressed against the pad 58 through the paper 16. The projection detecting member 34 is biased downwardly under the force of the coiled spring 38 and is arrested by the lower stopper pin 40 so that the bent portion 47 of the paper feed pawl 46 is in light contact with the tooth 49 of the ratchet wheel 48. After the print head 9 is energized so as to print one character, the rotary shaft 3 of the step motor 1 rotates by 90° in the right or clockwise direction so that the pulley 5 rotates through an angle in the counterclockwise direction, thereby winding the wire 8 by a predetermined length. Therefore the print head 9 on the carriage 10 is shifted to right by a distance equal to one space. As the step motor 1 continues its intermittent rotation in the clockwise direction, the pulley 5 rotates intermittently in the counterclockwise direction so that the print head 9 is advanced. When the projection 7 rotates through the maximum angle within the range B, the maximum number of digits are printed. The print head 9 is advanced only by the pulley 5, the wire 8 and the carriage 10 so that the construction is extremely simple.

In response to the function signal + from the function key 107, the carriage return signal CR is generated and the content of the counter is subtracted. Therefore the motor 1 is rotated in the counterclockwise direction so that the carriage 10 is returned. The operation of returning the carriage 10 is the reversal of the operation of advancing the carriage. That is, the step motor 1 is reversed. Even when the carriage 10 is returned, the tension of the spring 25 is applied to the other end 24 of the lever 22 so that the print head 9 is pressed against the pad 58 as in the case of printing. Because of the construction described above, automatic cleaning of the thermal print head 9 may be effected. The high temperature thermal head 9 is pressed against the heat-sensitive paper so that the fibers of the paper and other physical and chemical products tend to adhere to the thermal head 9. Therefore in the conventional thermal printers, the thermal head must be cleaned with a special cleaning agent, but according to the present invention the thermal print head is pressed against the pad when it is returned so that the undesired substances may be wiped off. When the carriage is returned with the print head being pressed against the pad to the print-start position $A_0$, the projection 7 of the pulley 5 is returned to the position indicated by the solid lines in FIG. 2. The counter further counts a few clock pulses so that the carriage 10 is further returned. In the instant embodiment, the print head 9 is so located that four clock pulses are counted after the carriage reaches the position $A_0$. As shown in FIG. 9 the projection 7 of the pulley 5 rotates in the range A in the clockwise direction when the print head 9 is returned to the position $A_0$. The projection detecting member 34 in engagement with the projection 7 is gradually lifted until the shock absorber 36 of the member 34 engages with the stopper pin 41. The actuating member 37 carried by the member 34 closes the contacts 28 and 29 of the switch so that the signal representing that the print head 9 has reached the end of the return stroke is transmitted through a lead wire 44 to the control unit 70. This signal is used as an $\overline{END}$ signal which is applied to the flip-flops 87, 96 and 98 to reset them, thereby deriving the signals FORWARD, $\overline{SIG}$ and $\overline{T}_3$. Therefore the counter is switched. When the projection 7 brings the projection position detecting member 34 to a horizontal position, the horizontal flat surface of the member 34 engages with one end 23 of the lever 22 and raises it against the force of the spring 25. Since the lever 22 is fixed to one end 18 of the supporting shaft 17, the latter is caused to rotate in the clockwise direction as the lever 22 rotates. The carriage 10 and hence the print head 9 is carried through the slider member 20 by the shaft 17, the print head 9 is moved away from the paper 16 as the shaft 17 rotates in the clockwise direction. The print head 9 if moved from the paper 16 by the maximum distance when the member 34 is arrested by the stopper pin 41. The paper feed lever 30 integral with the projection position detecting member 34 and bent at a right angle relative to the horizontal surface thereof is also raised in unsion with the projection position detecting member 34 as the projection 7 rotates. The force exerted from the projection 7 for raising the lever 30 is in excess of the force of the coiled spring 38 which tends to cause the lever 30 to move downwardly. The pawl 46 which is pivoted with a pin 31 to one end 32 of the paper feed lever 30 has the bent portion 47 engaged with the tooth 49 of the ratchet wheel 48 as the lever 30 rotates in the counterclockwise direction so that the ratchet wheel 48 is caused to rotate in the counterclockwise direction. As a result the shaft 51 of the ratchet wheel 48 is caused to rotate in the counterclockwise direction so that the paper feed roller 50 coupled to the shaft 51 is rotated. As a result the paper is gradually advanced. When the projection position detecting member 34 is arrested by the stopper pin 41, the paper is advanced to the maximum height and then stopped. Immediately before the projection position detecting member 34 engages with the stopper pin 41, the switch 27 is closed by the actuating member 27 so that the counter in the drive control unit is set to count the increment of the clock pulses. That is, the AND gate 122 is opened in response to the reset output signal $\overline{SIG}$ of the flip-flop 96 and to the close pulse CP so that the OR gate 123 is also opened. As a result the AND gate 116 is opened in response to the FORWARD signal which has been applied thereto and to the output signal of the OR gate 123 so that the counter starts counting the pulses. Therefore the step motor 1 starts the rotation again in the clockwise direction so that the pulley 5 starts the rotation in the counterclockwise direction and the projection 7 starts to move downwardly from the maximum point in the range A. When the projection 7 moves downwardly the projection position detecting member 34 is also moved downwardly under the force of the coiled spring 38 until it is arrested by the stopper pin 40. Thus the member 34 is returned to the initial position. The pawl 46 of the paper feed lever 30 is also moved downwardly and the bent portion 47 of the pawl 36 slides along the sloping surface of the tooth 50 of the ratchet wheel 48 under the force of the spring 45 and engages with the tooth 50. Thus the next paper feed step is prepared. The lever 22 is also returned to its initial position under the force of the spring 25 so that the print head 9 is pressed against the pad 58 through the paper 16. The pulses required for stepping the print head 9 to the print-start position $A_0$ are four which equals to the number of pulses required for stepping the print head 9 from the position $A_0$ to the position $-A_0$ because the counter in the control unit stops counting after it has correctly counted four pulses. As is clear from the waveforms shown in FIGS. 14 A and B, the time when the signal $\overline{SIG}$ is at a high level, starts from the time when the set output $T_2$ of the flip-flop 95 falls for the first time since the BACK signal has been generated to the time when the output $T_2$ falls for the first time since the reset output FORWARD signal of the flip-flop 87 has been generated in response to the $\overline{END}$ signal of the switch 27. Thus the counter may correctly count four clock pulses CP and store them so that the print head 9 may be correctly stopped at the print start position $A_0$. As described hereinbefore according to the present invention the print head 9 may be correctly stopped at the print-start position.

In addition to the thermal head described hereinabove, any other suitable head such as a discharge printing needle head, a wire matrix print head, a ball type print head, an electric field print head, an ink ejecting print head and so on may be employed.

Figure 7:
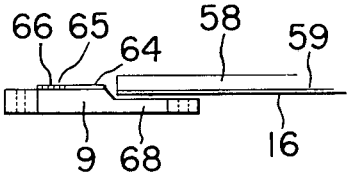
FIG. 7 is a view illustrating a variation of the thermal print head shown in FIG. 6.

When the thermal head is provided with a notch 68 as shown in FIG. 7, the mechanism for changing the print position of the print head may be eliminated from the embodiment described hereinbefore with reference to FIGS. 1–5.

Figure 8:
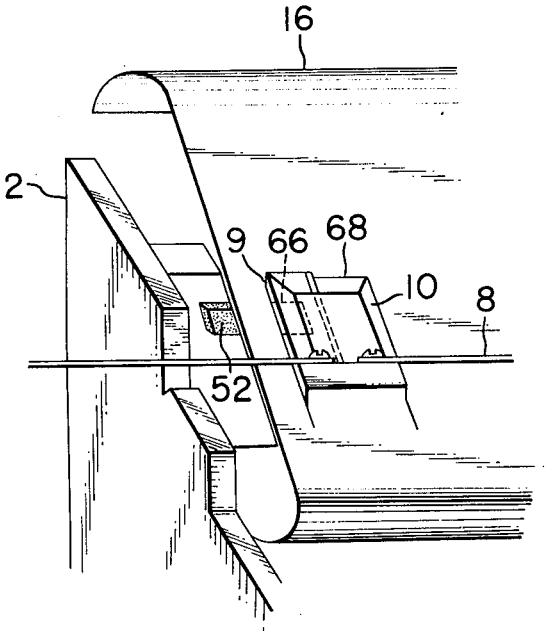
FIG. 8 is a fragmentary perspective view illustrating a variation of a printer of the present invention of the type employing the print head shown in FIG. 7.

According to the present invention the print head 9 is returned beyond the print start position so that means for cleaning the print head and means for improving the heat dissipation may be specially provided as shown in FIG. 8. In case of the print head 9 having the heat generating elements 66, cleaning means (for example a felt or the like impregnated with silicon oil, monoethyldiphenyl, diethylidiphenyl or the like) is provided on the intermediate side plate 2 for cleaning the elements 66. More particularly when the print head 9 is returned beyond the print start position and the paper 16, it makes contact with the cleaning means 52 so that the elements 66 may be cleaned. This cleaning means is very effective especially in case of a thermal head having the heat generating elements 66 which are easily susceptible to contaminations. The cleaning means may be provided for other types of print heads such as a discharge print head, an ink ejecting print head or the like which are rapidly contaminated. That is, the most effective cleaning means for certain print head is disposed upon the intermediate side plate 2 so that the print head may be cleaned when it is moved out of the paper 16. In the embodiment shown in FIG. 8 the print head of the type having a notched portion 68 as shown in FIG. 7 is used so that the heat generating elements 66 may be made into contact with the cleaning means 52 while the print head is in print position, that is while the print head is pressed against the paper 16. Therefore the force which presses the print head 9 against the paper 16 may be used very advantageously in cleaning. In this case the paper feed is effected through the space defined by the notched portion 68. However in case of the embodiment shown in FIG. 1 the paper feed is effected when the print head is changed in position so that the cleaning means may be disposed so as to make contact with the print head whose position is changed. Furthermore when the light and intermittent contact of the print head with the cleaning means 52 is made by utilizing the reciprocal motions of the print head 9 when the latter is changed in position, the remarkable cleaning effect may be expected. Moreover the cooling of the thermal head whose temperature is high may be expected by the contact with the cleaning means. That is, the heat dissipation is improved by conduction. When a heat dissipation improvement means 52 made of a material having a high thermal conductivity such as aluminum is provided, the heat dissipation is further improved so that the service life of the print head may be considerably improved.

According to the present invention when the continuous paper feed is required, a paper feed key (not shown) is kept depressed so that the AND gate 113 is intermittently and continuously opened and closed for each line. Therefore the paper may be advanced by desired lines. More particularly the paper is advanced by one line when the print head 9 is advanced from the print start position $A_0$ to the position $-A_0$. Therefore when the logic product of the PFE signal from the paper feed key and the SIG signal is provided, the paper is advanced by one line as in the case of the paper feed effected in response to the CR signal. Since the above step is cycled as long as the paper feed key is depressed, the paper may be advanced by any desired line. The above paper feed mechanism is very simple as compared with the conventional mechanical paper feed mechanisms and is one of the important features of the present invention.

A further important features of the present invention resides in the fact that the arrangement is very advantageous because only the symbol = is always printed at the leftmost print start position. When the key 103 for generating the command for printing the result of arithmetic operation is depressed as shown in FIG. 12, the signal −KF is applied to the AND gate 112 (NAND gate 84) and to the AND gate 105 because the flip-flop 104 is set. When the print head 9 is located at a position except the print start position $A_0$, that is when the print head 9 is stepped, both the SIG signal and the output signal $\overline{O}$ of the AND gate 121 are at a high level. As a result the AND gate 112 is opened so that in the manner described hereinbefore the counter starts the subtraction in order to bring the print head to the print start position. Therefore the print head is reversed in direction and stepped to the print start position $A_0$. When the print head 9 is stopped at the print start position $A_0$, the flip-flop 104 remains set and the output signal $\overline{O}$ of the OR gate 121 falls to a low level whereas the signal O rises to a high level. Therefore the AND gate 105 is opened so that the set output =KF of the flip-flop 104 is entered into the control unit 106. The symbol such as = for representing the printing of the result of the arithmetic operation is printed at the print start position $A_0$ and then the result is printed.

The control unit 106 generates the signal representing the number of significant digits stored in the register (not shown) or the signal representing the completion of the transfer of one word from the register. This signal is applied to the OR gate 109 so as to actuate the monostable multivibrator 110, thereby generating the carriage return signal CR. In this case, the signal resets the flip-flop 104. Therefore the print head 9 is returned to and stopped at the print start position $A_0$ for the next printing operation.

Figure 2:
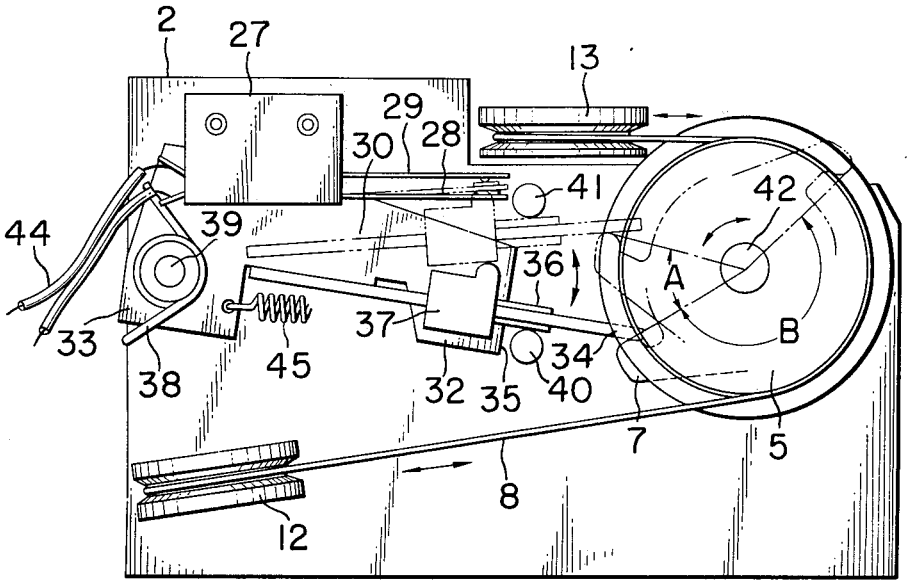
FIG. 2 is a sectional view taken along the line A–A' of FIG. 1.
Figure 3:
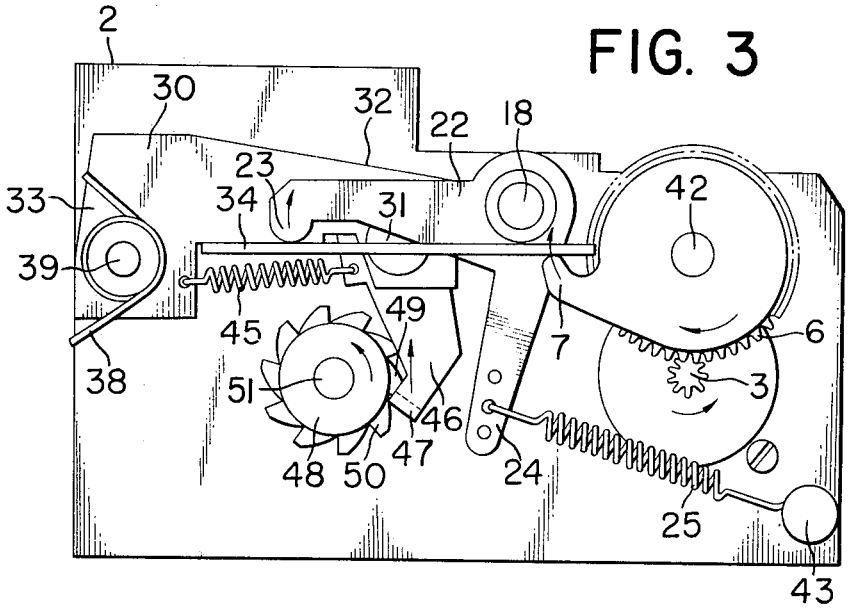
FIG. 3 is a sectional view taken along the line B–B' of FIG. 1.
Figure 4:
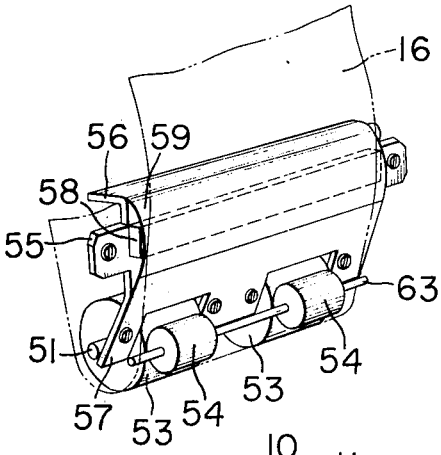
FIG. 4 is a perspective view illustrating a paper feeding mechanism of the printer shown in FIG. 1.
Figure 5:
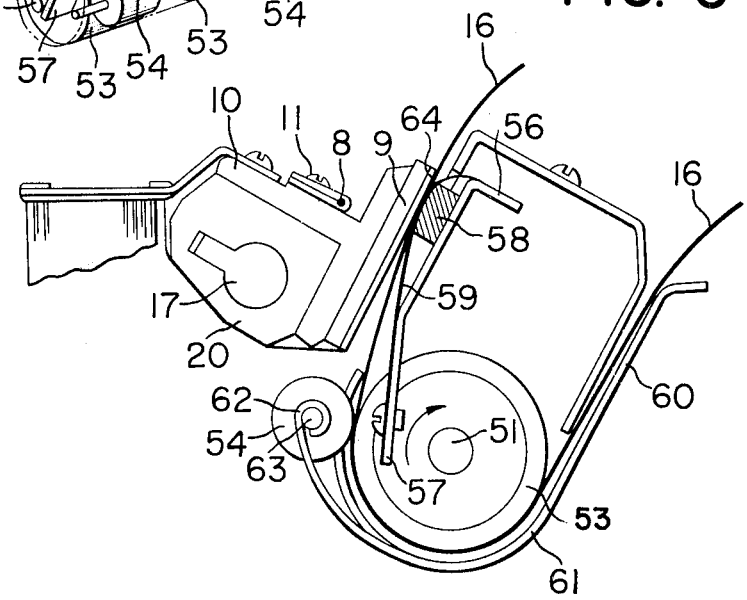
FIG. 5 is a fragmentary sectional view illustrating a print head pressed against a paper.

As shown in FIG. 9 the symbols such as "X,÷, + and −" are printed after the operands or numerals as shown in FIG. 2, and the result of the arithmetic operation is always printed after the symbol = which is printed at the print start position. Therefore it becomes very easy for an operator to see the result.

As described hereinbefore according to the present invention the print head is returned beyond the print start position so that many advantages may be obtained. In response to the detection of the print head 9 which has reached the end of the return stroke, the drive control means is energized so that the print head may be returned to the print start position $A_0$ in response to the minimum number of drive signals. Therefore the print head may be correctly returned to the print start position so that the first digits of the numerals may be printed correctly in line with each other. It should be noted that the print head is only required to be returned beyond the print start position not the paper 16.

Thus the present invention provides a high-spe printer in which all of the operations required for printing may be accomplished by a single driving means and which may be designed compact in size and light in weight. The high-speed printer in accordance with the present invention has many advantages that the print head is correctly located at the print start position, the drive control circuit is simple, means is provided for cleaning the print head, and means is provided for improving the heat dissipation of the print head.

We claim:

1. A printer comprising:

a. a printing head for printing characters, symbols, numerals or the like on a recording medium;

b. carriage means adapted to move said printing head thereon along a lateral direction of said recording medium;

c. means for feeding said recording medium along a longitudinal direction thereof;

d. means for pressing said printing head against said recording medium;

e. means for releasing said pressing means from pressing said printing head against said recording medium;

f. a reversible stepping motor for developing a driving force to move said printing head on said carriage means and to actuate said releasing means;

g. first transmitting means for transmitting the rotational driving force of said motor to said carriage means;

h. second transmitting means for transmitting the rotational force of said motor to said releasing means; and i. control means coupled to said stepping motor for generating first and second stepping pulses having first and second frequencies, respectively to move said printing head on said carriage means at different speeds corresponding to the pulse frequencies applied to the motor.

2. A printer according to claim 1, wherein said reversible stepping motor provides the driving force to actuate said feeding means, and said printer further comprises third transmitting means for transmitting the rotational force of said motor to said feeding means.

3. A printer comprising:

a. a printing head for printing characters, symbols, numerals or the like on a recording medium;

b. carriage means adapted to move said printing head thereon along a lateral direction of said recording medium;

c. means for feeding said recording medium along a longitudinal direction thereof;

d. means for pressing said printing head against said recording medium;

e. means for releasing said pressing means from pressing said printing head against said recording medium;

f. a reversible stepping motor for developing a driving force to move said printing head on said carriage means and to actuate said feeding means;

g. first transmitting means for transmitting the rotational driving force of said motor to said carriage means;
h. second transmitting means for transmitting the rotational driving force of said motor to said feeding means; and
i. control means coupled to said stepping motor for generating first and second stepping pulses having first and second frequencies, respectively to move said printing head on said carriage means at different speeds corresponding to the pulse frequencies applied to the motor.

4. A printer comprising:
a. a printing head for printing characters, symbols, numerals or the like on a recording medium;
b. carriage means adapted to move said printing head thereon along a lateral direction of said recording medium;
c. means for feeding said recording medium along a longitudinal direction thereof;
d. means for pressing said printing head against said recording medium;
e. means for releasing said pressing means from pressing said printing head against said recording medium;
f. a motor for developing a driving force to move said printing head on said carriage means and to actuate said releasing means;
g. first transmitting means for transmitting the rotational driving force of said motor to said carriage means;
h. second transmitting means for transmitting the rotational force of said motor to said releasing means, and
i. control means coupled to said motor for controlling the driving force of said motor to move said printing head on said carriage means at different speeds in the different running directions of said printing head.

5. a printer according to claim 4, wherein said motor provides the driving force to actuate said feeding means, and said printer further comprises third transmitting means for transmitting the rotational force of said motor to said feeding means.

6. A printer comprising:
a. a printing head for printing characters, symbols, numerals or the like on a recording medium;
b. carriage means adapted to move said printing head thereon along a lateral direction of said recording medium;
c. means for feeding said recording medium along a longitudinal direction thereof;
d. a motor for developing a driving force to move said printing head on said carriage means and to actuate said feeding means;
e. first transmitting means for transmitting the rotational driving force of said motor to said carriage means;
f. second transmitting means for transmitting the rotational driving force of said motor to said feeding means; and
g. control means coupled to said motor for controlling the driving force of said motor to move said printing head on said carriage means at different speeds in the different running directions of said printing head.

7. A printer according to claim 6, wherein said motor comprises a stepping motor, and said control means comprises a control circuit for generating first and second pulses having first and second frequencies, respectively, said first and second pulses being selectively applied to said stepping motor so that said printing head can be moved on said carriage means at different speeds corresponding to the pulse frequencies.

8. A printer comprising:
a. a printing head for printing characters, symbols, numerals or the like on a recording medium;
b. carriage means adapted to move said printing head thereon along a lateral direction of said recording medium;
c. a reversible stepping motor for developing a driving force to move said printing head on said carriage means, said motor having a plurality of coils and a rotary shaft which is coupled to said carriage means; and
d. a control circuit for generating first and second stepping pulses having first and second frequencies, respectively, said first and second stepping pulses being selectively applied to the coils of said reversible stepping motor so that said printing head can be moved on said carriage means in a first direction by application of said first pulses to the coils of said motor, and in a second direction opposite to the first direction by application of said second pulses to the coils of said motor, and said second frequency being higher than said first frequency so that said printing head is moved at relatively high speed in the second direction, said control circuit having a first control function wherein after one row of printing is completed along the lateral direction of said recording medium, the rotation of said motor is switched from regular rotation to reverse rotation so that said print head is returned toward the printing start position, a second control function wherein reverse rotation of said motor is continued at least unitl said printing head reaches the printing start position, and a third control function wherein after said printing head reaches the printing start position, the rotation of said motor is switched from reverse rotation to regular rotation, and the row line is displaced, so that the printing operation is started from the printing start position on a new row line.

9. A printer according to claim 8, wherein said control circuit comprises a driving circuit connected to the plurality of coils of said motor for energizing the coils, a counter circuit coupled to said driving circuit, gating means coupled to said counter circuit, a first pulse generator for generating a first pulse train to move said printing head on said carriage means in the first direction, said first pulse train being selectively applied to said counter circuit through said gating means, and a second pulse generator for generating a second pulse train to move said printing head on said carriage means in the second direction at a relatively high speed, said second pulse train being selectively applied to said counter.

10. A printer according to claim 8, wherein said printing head is a thermal head.

11. A printer according to claim 8, wherein said control circuit serves to make the motor continue reverse rotation, even after said printing head reaches and passes through the printing start position, and to stop said printing head at an over-running position.

12. A printer according to claim 11, wherein said control circuit serves to make the motor drive in regular rotation by application of said second pulse having the second frequency to the motor unitl said printing head reaches the printing start position from said over-running position.

* * * * *